US007090297B2

(12) United States Patent
Mohn et al.

(10) Patent No.: US 7,090,297 B2
(45) Date of Patent: Aug. 15, 2006

(54) HEAVY LIFT CHAIR

(75) Inventors: Michael E Mohn, Monroe, MI (US); Andrew C Resovsky, Ypsilanti, MI (US); Larry P LaPointe, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 0 days.

(21) Appl. No.: 10/964,286

(22) Filed: Oct. 13, 2004

(65) Prior Publication Data

US 2006/0076813 A1 Apr. 13, 2006

(51) Int. Cl.
*A47C 7/02* (2006.01)

(52) U.S. Cl. ..... 297/330; 297/DIG. 10

(58) Field of Classification Search ..... 297/344.12, 297/344.17, 326, 325, 330, 85, DIG. 10, 297/338, 339

See application file for complete search history.

(56) References Cited

U.S. PATENT DOCUMENTS 4,126,939 A * 11/1978 Pyne, Jr. ..... 433/79
4,850,645 A * 7/1989 Crockett ..... 297/330
5,061,010 A 10/1991 LaPointe
5,158,074 A * 10/1992 Grellas ..... 601/24
5,163,451 A * 11/1992 Grellas ..... 128/898
5,495,811 A * 3/1996 Carson et al. ..... 108/147
6,000,758 A * 12/1999 Schaffner et al. ..... 297/344.17

* cited by examiner

*Primary Examiner*—Rodney B. White
*Assistant Examiner*—Stephen Vu
(74) *Attorney, Agent, or Firm*—Harness, Dickey & Pierce, P.L.C.

(57) ABSTRACT

A power-assisted heavy lift chair comprises a base assembly. A chair frame is supported on the base assembly. A lift mechanism communicates with the base assembly and the chair frame, and is operable to actuate the chair frame between first and second positions. A transformer provides electrical power to an electric motor. The electric motor provides rotational power to the lift mechanism at a first rate to lift and/or lower the chair frame. The electric motor draws current from the transformer according to a load upon the chair frame. The rate that the electric motor lifts and/or lowers the chair frame depends upon the voltage provided by the transformer. The transformer is operable to provide a generally constant voltage regardless of the current draw of the electric motor. Therefore, the electric motor lifts and/or lowers the chair at a constant rate independent of the load on the chair.

16 Claims, 4 Drawing Sheets

HEAVY LIFT CHAIR

FIELD OF THE INVENTION

The present invention relates to power-assisted articles of furniture and, more particularly, to a power-assisted heavy lift chair that provides constant lift and lowering power independent of the load on the chair.

BACKGROUND OF THE INVENTION

Conventionally, power-assisted chairs include a motor-operated lift mechanism for aiding persons that require assistance in entering or exiting the chair. More particularly, motor-operated lift mechanisms are interconnected between a stationary base assembly and a moveable chair frame. Alternatively, some power-assisted chairs include separate linkage mechanisms for permitting the seat occupant to selectively extend and retract a leg rest assembly and/or produce reclining angular movement between an upright first position and a reclined second position.

Power-assisted chairs may be adapted to provide the lift and tilt function in combination with a leg rest and/or reclining function. Chairs which provide such a combination of multi-positional functions generally require the use of multiple motors for driving the separate linkages, which results in extremely large and expensive chair units. In addition, most power-assisted chairs incorporate a drive mechanism that employs both a power drive function for extending the leg rest, lifting the chair, and reclining the chair, and a power return function for returning the chair to the normal seated position.

An important characteristic of power-assisted chairs is the ability to support heavy loads during the lift and tilt functions. More specifically, power-assisted chairs are designed to support individuals of a particular weight. Typically, power-assisted chairs that are adapted to support weight above a particular threshold, such as 300 pounds, require multiple motors.

SUMMARY OF THE INVENTION

A power-assisted heavy lift chair comprises a base assembly. A chair frame is supported on the base assembly. A lift mechanism communicates with the base assembly and the chair frame, and is operable to actuate the chair frame between first and second positions. A transformer receives a first voltage from a power supply and is operable to output a second voltage that is constant. An electric motor receives the second voltage and provides rotational power to the lift mechanism at a first rate according to the second voltage to lift and/or lower the chair frame.

In another aspect of the invention, the power-assisted heavy lift chair further comprises a heating element that receives a third voltage from the transformer. The heating element is operable to provide heat to areas of the heavy lift chair in response to the third voltage. The heating element is operable to automatically discontinue providing heat during lift and/or lower operations of the heavy-lift chair.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
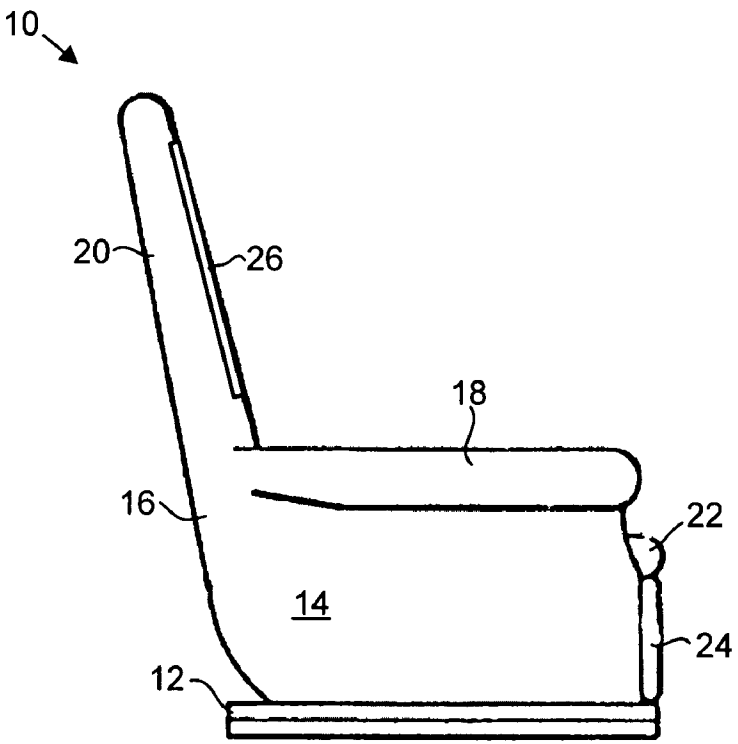
FIG. 1 is a side elevation view of a reclinable lift chair, in a seated position, mounted on a lift base assembly according to the prior art.
Figure 2:
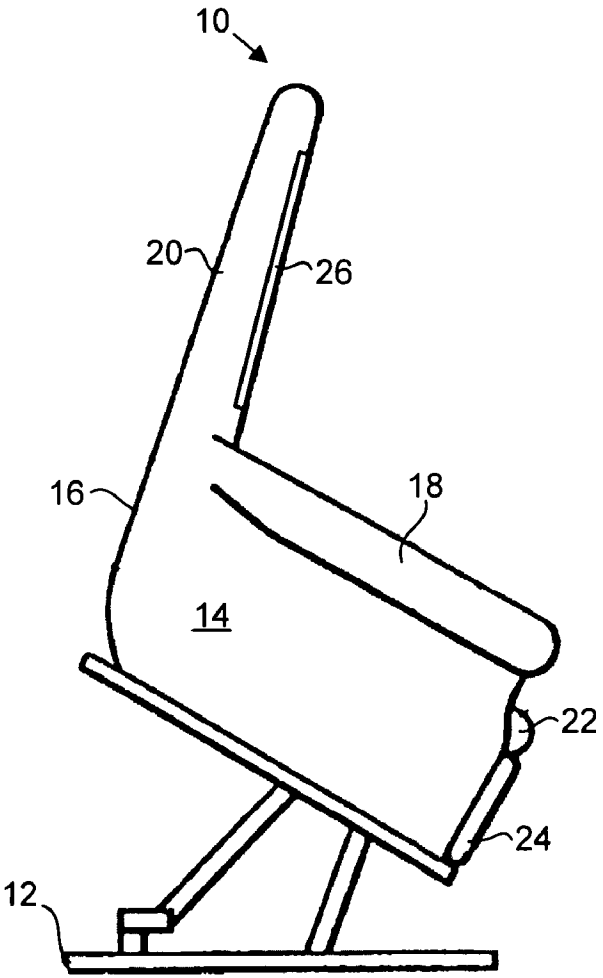
FIG. 2 is a side elevation view of a reclinable lift chair, in a fully extended position, mounted on a lift base assembly according to the prior art.

A heavy lift chair 10 includes a lift base assembly 12 and a chair 14 as shown in FIG. 1. The lift base assembly 12 supports the chair 14 in a normal seated position. The lift base assembly 10 lifts the chair 14 to a tilted position that makes it easier for a person to enter or leave the chair 14 as shown in FIG. 2. Any of a wide variety of chair constructions can be used with the lift base assembly 10. The chair 14 includes a frame 16, side arms 18, a seat back 20, and a seat portion 22. The seat back 20 may recline in response to pressure from the back of an occupant and the seat portion 22 may move simultaneously with the seat back 20. The chair 14 also includes an extensible leg rest assembly 24. Additionally, the seat back 20 and/or the seat portion 22 may include a heat pad 26. The heat pad 26 may be selectively energized to provide heat to person using the chair 10.

Figure 3:
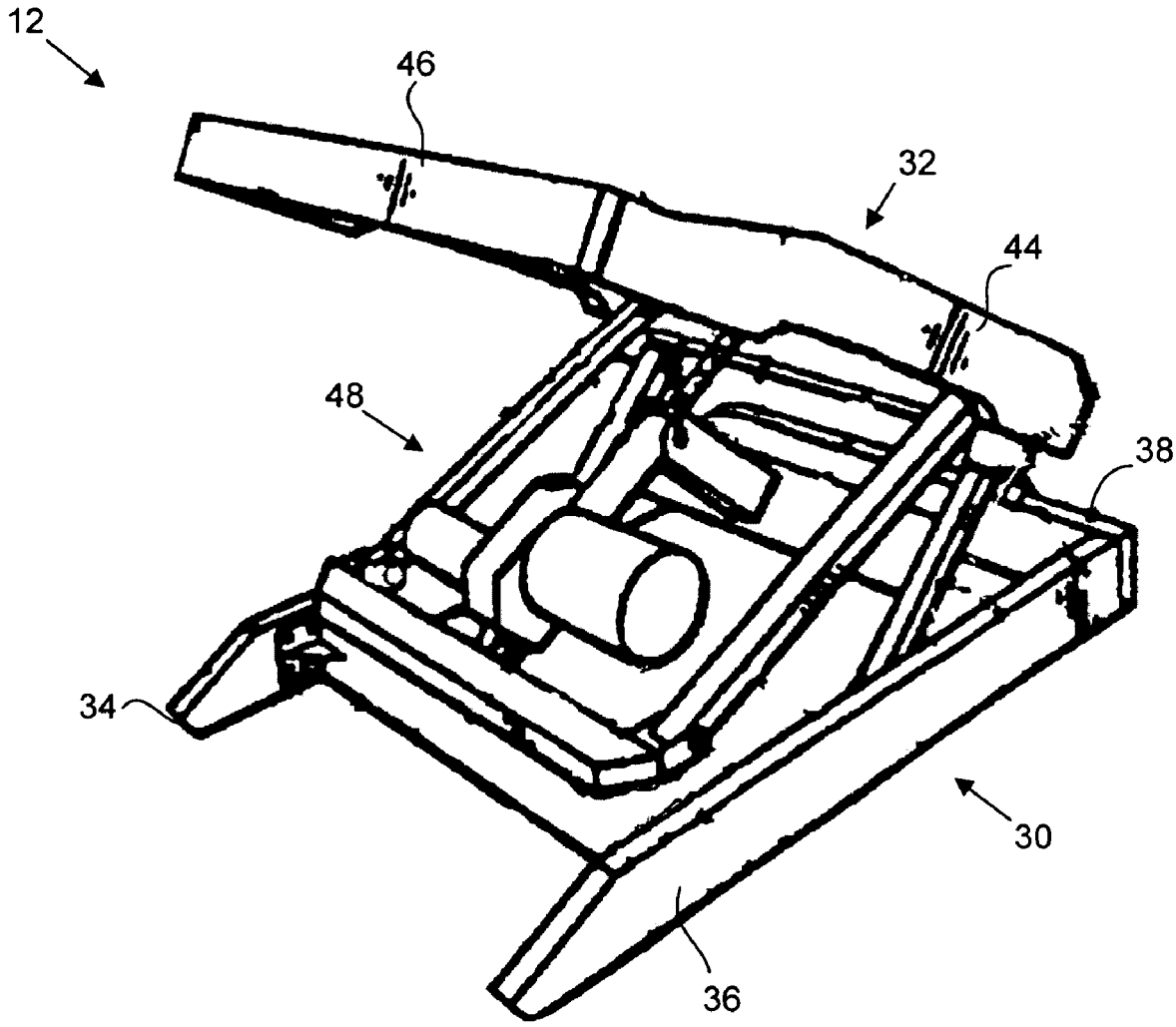
FIG. 3 is a perspective view of a lift base assembly according to the prior art.
Figure 4:
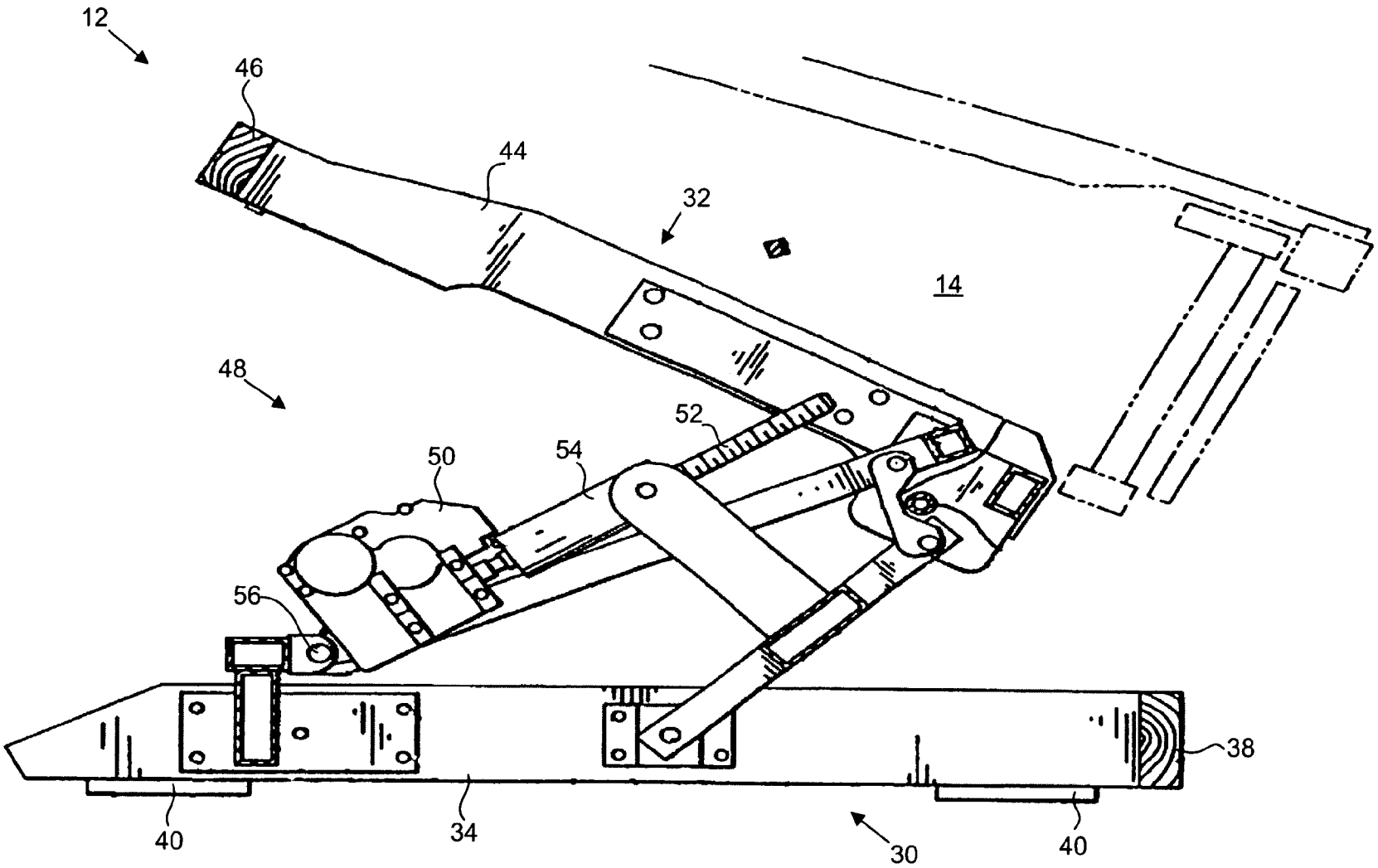
FIG. 4 is a cross-sectional view of a lift base assembly according to the prior art.

An exemplary lift base assembly 12 is shown in FIGS. 3 and 4. The lift base assembly 12 has a stationary, rectangular bottom frame member 30 that rests on the floor and a movable, rectangular upper frame member 32 on which the chair 14 is removably but securely attached by suitable fasteners. The bottom frame member 30 includes left and right hand side members 34 and 36, respectively, that are rigid with a front cross member 38. Side members 34 and 36 may have suitable pads 40 that engage the surface of a floor. Upper frame member 32 includes left and right side members 42 and 44, respectively, that are rigid with a rear cross member 46. A lift mechanism 48 nests inside of the bottom from member 30, the upper frame member 32, and the chair 14.

The lift mechanism 48 includes a power-assist means, such as an electric motor 50, a rotary screw shaft 52, and an internally threaded sleeve or nut 54. The motor 50 is selectively operable to rotate the screw shaft 52 in either a first direction or second direction. Both the motor 50 and the screw shaft 52 can arcuately swing up and down in a generally vertical plane about a pivot 56. The screw shaft 52 extends through and drives the sleeve 54 so that the sleeve 54 moves forwardly or rearwardly along the length of the screw shaft 52 upon rotation of the screw shaft 52 in one of the first and second directions. In the seated or lowered position of the chair 14, the sleeve 54 Is positioned near the front or outer end of the screw shaft 52. Lifting of the chair 14 is accomplished by energizing the motor 50 to rotate the screw shaft 52 in a direction that pulls the sleeve 54 toward the motor 50. To lower the chair 14, rotation of the screw shaft 52 is reversed, which draws the sleeve 54 away from the motor 50. The above lift base assembly 12 and lift mechanism 48 are described in more detail in U.S. Pat. No. 5,061,010, assigned to La-Z-Boy Chair Co., which is hereby incorporated by reference in its entirety. Although the above lift base assembly and lift mechanism are described for illustrative purposes, it is to be understood that other suitable lift base assemblies and lift mechanisms may be used with the present invention as it is described below.

Figure 5:
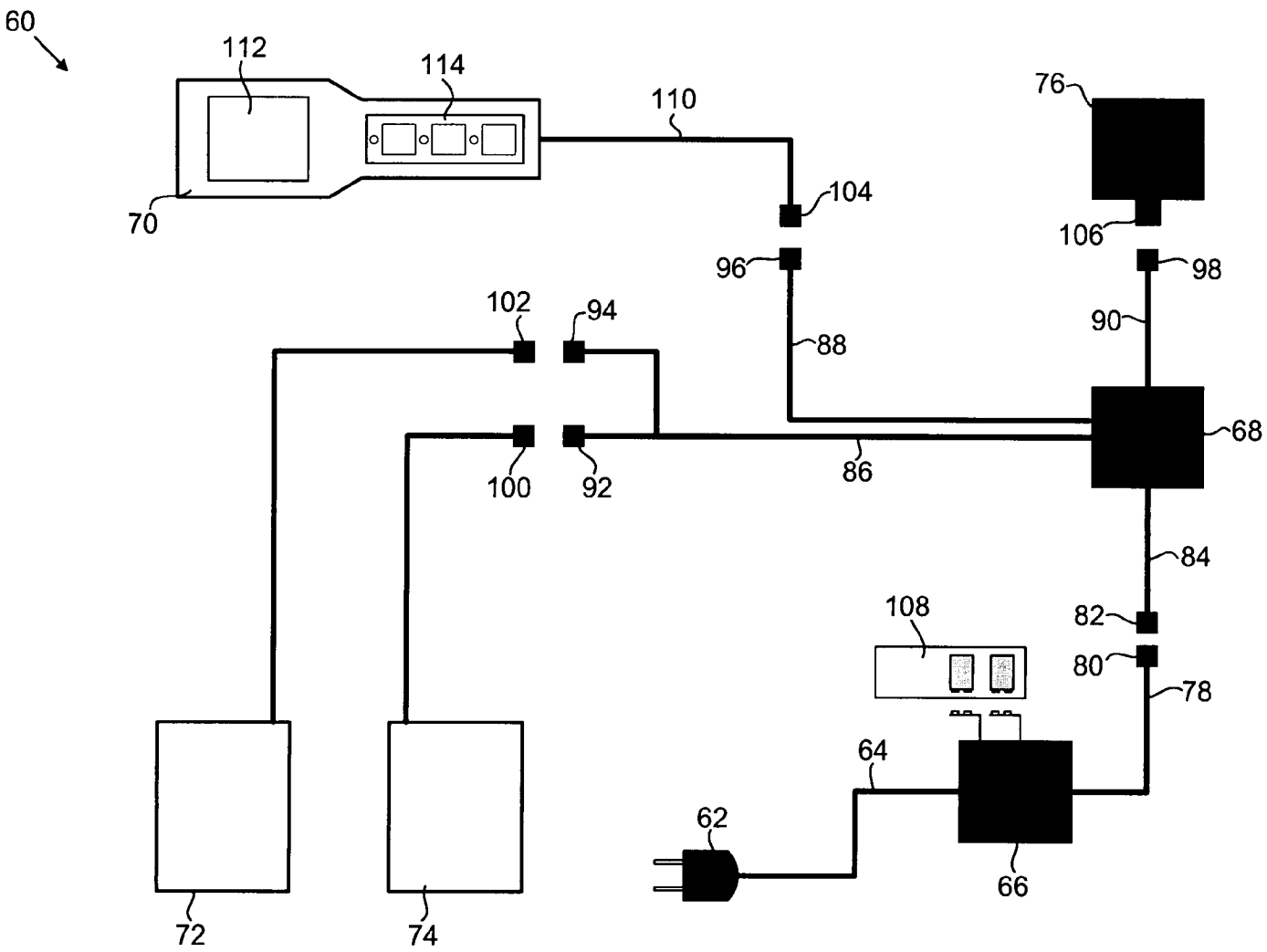
FIG. 5 is a wiring diagram of an electrical control system of a power-assisted chair according to the present invention.

As shown in FIG. 5, an electrical control system 60 for the motor 50 includes two-prong attachment plug 62 that fits into an electrical receptacle in the general proximity to where the lift base assembly 12 is used for providing electrical current to operate the lift assembly 12. Alternatively, the attachment plug 62 may be a three-prong grounding plug that fits into a grounding-type receptacle. The plug 62 includes an insulated cable or power cord 64 of suitable length. The electrical control system 60 also includes a transformer 66, an electrical controller 68, a control wand 70, heating pads 72 and 74, a motor actuator 76, and various male and female socket connectors for connecting the components of the electrical control system 60 as described below.

The transformer 66 includes a power cord 78 with three current-carrying inductors that terminate in a male socket connector 80. The male socket 80 mates with a female socket connector 82 so that the transformer 66 is electrically connected to the electrical controller 68 through a power cord 84. The electrical controller 68 further includes power cords 86, 88, and 90. The power cord 86 includes four current-carrying conductors that terminate in a male socket connector 92 and a female socket connector 94. The power cord 88 includes eight current-carrying conductors that terminate in a female socket connector 96. The power cord 90 includes five current-carrying conductors that terminate in a male socket connector 98. The socket connectors 92, 94, 96, and 98 mate with counterpart socket connectors 100, 102, 104, and 106, respectively, to electrically connect the electrical controller 68 to the control wand 70, the heating pads 72 and 74, and the motor actuator 76.

The transformer 66 receives AC power from a standard electrical receptacle via the power cord 64. The transformer 66 steps down the input power, for example 120 volts of AC, to an output power. In the preferred embodiment, the transformer 66 outputs an AC voltage of 12 volts and a constant DC voltage of 27 volts. The transformer 66 includes batteries, such as 9 volt batteries 108, which may provide backup power to the electrical system 60 in the event of a power failure. The heating pads 72 and 74 are powered by the 12 volts AC and the motor actuator 76 is powered by the 27 volts DC.

The electrical controller 68 receives both the 12 volts AC and the 27 volts DC from the transformer 66. The electrical controller 68 distributes the power from the transformer 66 to the heating pads 72 and 74, the motor actuator 76, and the control wand 70. The electrical controller 68 directs the 12 volts AC to the heating pads 72 and 74 and directs the 27 volts DC to the motor actuator 76. The control wand 70 also receives power from the 27 volt DC supply.

The control wand 70 includes a control cord 110 for receiving power from the electrical controller 68. The control wand 110 may be mounted to a side arm of the chair or, alternatively, held and operated by a person using the chair. Additionally, the control cord 110 communicates commands from the control wand 70 to the electrical controller 68. For example, the control wand 70 includes indicator means 112, such as an LED array, and one or more control switches 114. The user may control the various operations of the chair with the switches 114, such as lifting and lowering functions, reclining functions, and "on" or "off" status of the heating pads 72 and 74. When the user operates the switches 114 to lift the chair, electrical power is supplied to the motor actuator 76 to rotate the screw shaft in a direction to cause the chair to lift. When the user operates the switches 114 to lower the chair, electrical power is supplied to the motor actuator 76 to rotate the screw shaft in the opposite direction for lowering the chair. The user may view status information for the chair at the indicator means 112, such as "on" or "off" status or relative temperature indicators of the heating pads 72 and 74.

The control wand 70 is powered by the 27 volt DC supply. However, the control wand 70 does not directly switch the current load of the motor actuator 76. Instead, the control wand 70 switches relays located in the electrical controller 68 in order to control power to the motor actuator 76. In this manner, the high current draw of the motor actuator 76 does not pass through the control wand 70. In an alternative embodiment, the indicator means 112 and/or the switches 114 are located directly on the chair rather than on the control wand 70. For example, the indicator means 112 and switches 114 may be located on a side arm of the chair.

The motor actuator 76 receives electrical power from the electrical controller 68 through the electrical connection of the power cord 90, the male socket connector 98, and the female socket connector 106. The motor actuator 76 provides rotational power to the screw shaft according to the electrical power received from the electrical controller 68. For example, if the user operates the switches 114 to lift the chair, the motor actuator 76 receives electrical power of a first polarity to rotate the screw shaft in a first direction. If the user operates the switches 114 to lower the chair, the motor actuator 76 receives electrical power of a second polarity to rotate the screw shaft in a second direction.

The rate at which the motor actuator 76 lifts and lowers the chair is directly dependent upon the DC voltage received from the transformer 66 through the electrical controller 68. In the preferred embodiment, the DC voltage is 27 volts. The current drawn by the motor actuator 76, however, is proportional to the load upon the chair. If the chair is empty, the motor actuator 76 requires relatively low current. If the chair is loaded with a person, the motor actuator 76 requires higher current. Conventionally, motor actuators receive a particular power input to control the lift and lowering functions. As the load upon the chair increases, the motor actuator draws more current. Because power is a product of voltage and current ($P=VI$), the voltage of the motor actuator decreases proportionately as current draw increases. As voltage decreases, the lift rate of the chair decreases proportionately. Therefore, it can be seen that the lift and/or lower rates of conventional power-assisted chairs were extremely dependent upon the load on the chair at any particular time.

In contrast, the transformer 66 of the present invention is operable to output a generally constant DC voltage regardless of the current draw from the motor actuator 76. One such transformer available is InSeat Solutions' AC/DC adaptor, model number 15541 Class II power transformer, which outputs a 12 volt AC supply and a 27 volt DC supply. If the motor actuator 76 draws more current due to a heavier load upon the chair, the transformer adjusts automatically to maintain a generally constant DC voltage output of 27 volts to the motor actuator 76. The motor actuator 76 receives a constant voltage regardless of the current draw. Therefore, the motor actuator 76 provides constant rotational power to the screw shaft. In this manner, the power-assisted chair of the present invention provides generally constant lift and lowering rates independent of the load on the chair. Further, the power-assisted chair of the present invention is able to provide constant lift and lowering rates for loads up to 500 hundred pounds with a single motor.

The required time to complete a full lift or lower cycle is dependent upon the lift or lower rate of the motor, and therefore is further dependent upon the voltage output of the transformer. Because the DC voltage supply of the transformer is generally constant, lift and lower cycles will be consistent regardless of the weight of the person using the chair. For example, slight voltage drops due to extremely heavy loads may cause the lift cycle to have a slightly longer duration, and the lower cycle to have a slightly shorter duration. Although cycle times may vary slightly due to factors such as increased heat due to higher current draw and other process variables, a person using the chair may expect generally uniform lift and lower cycle times.

Additionally, the electrical control system 60 is operable to selectively control power to the heating pads 72 and 74 during lift and lower operations of the motor actuator 76, which allows the transformer 66 to maintain a Class II rating. For example, if the user operates the switches 114 to lift or lower the chair while the heating pads 72 and 74 are "on," the electrical controller 68 will turn off power to the heating pads 72 and 74. Once the lift or lower operation is complete, the electrical controller 68 will restore power to the heating pads 72 74. In this manner, the electrical controller 68 directs power solely to the motor actuator 76 during lift and lower operations, which allows the motor actuator 76 to receive the maximum power available.

The electrical control system 60 may include other electrical components, such as a vibratory massage device, an air pillow massage device, or other devices as are known in the art. The additional devices may operate on the 12 volt AC supply in a fashion similar to the heating pads 72 and 74. Correspondingly, the electrical controller 68 may disable power to the additional devices during motor lift and lower operations.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A power-assisted heavy lift chair comprising:

a base assembly, a chair frame supported on the base assembly, a lift mechanism that includes a rotational shaft, the rotational shaft communicating with the base assembly and the chair frame, and being operable to raise and lower the chair frame between raised and lowered positions;

a transformer that receives a first voltage from a power supply and is operable to output a second voltage at a constant value independently of the current;

an electric motor that draws current from the transformer according to a load on the chair frame, receives the second voltage, and provides rotational power to the lift mechanism via the rotational shaft at a first rate according to the second voltage independently of the current;

wherein the rotational shaft rotates at a rate dependently of the second voltage and independently of a load on the chair so that the lift chair raises and lowers at a constant rate.

2. The power-assisted heavy lift chair of claim 1 wherein the base assembly further comprises:

a first frame member that is stationary; and a second frame member that is actually attached to the first frame member and fixedly attached to the chair frame, wherein the lift mechanism communicates with the first frame member and the second frame member.

3. The power-assisted heavy lift chair of claim 1 wherein the second voltage is a DC voltage.

4. The power-assisted heavy lift chair of claim 1 further comprising a heating element that provides heat to one or more areas of the heavy lift chair.

5. The power-assisted heavy lift chair of claim 4 wherein the transformer is further operable to output a third voltage.

6. The power-assisted heavy lift chair of claim 4 wherein the third voltage is an AC voltage.

7. The power-assisted heavy lift chair of claim 4 wherein the heating element receives the third voltage.

8. The power-assisted heavy lift chair of claim 7 further comprising an electrical power controller that receives the second voltage and the third voltage from the transformer.

9. The power-assisted heavy lift chair of claim 8 wherein the electrical power controller is operable to distribute the second voltage to the electric motor and the third voltage to the heating pad.

10. The power-assisted heavy lift chair of claim 9 wherein the electrical power controller is operable to stop distributing the third voltage to the heating pad if the electric power controller is distributing the second voltage to the electric motor.

11. The power-assisted heavy lift chair of claim 4 further comprising one or more switches for controlling power to the heating pad and the electric motor.

12. The power-assisted heavy lift chair of claim 11 wherein the switches are located on an arm of the chair frame.

13. The power-assisted heavy lift chair of claim 11 wherein the switches are located on a control device that is electrically connected to the heavy lift chair.

14. The power-assisted heavy lift chair of claim 1 wherein the lift mechanism is operable to actuate the chair frame from the first position to the second position within a threshold of a first period and is operable to actuate the chair frame from the second position to the first position within said threshold.

15. The power-assisted heavy lift chair of claim 14 wherein the chair frame is operable to support a load and the lift mechanism is operable to actuate the chair frame from the first position to the second position within the threshold and is operable to actuate the chair frame from the second position to the first position within the threshold independent of the load.

16. A power-assisted heavy lift chair comprising:

a base assembly;

a chair frame supported on the base assembly that is operable to support a load;

a lift mechanism that communicates with the base assembly and the chair frame, and that is operable to actuate the chair frame between first and second positions within a threshold of a first period independent of the load;

an electric motor that communicates with the lift mechanism and provides rotational power to the lift mechanism;

a transformer that receives an AC voltage from a power supply and is operable to output a constant DC voltage; wherein the electric motor receives the constant DC voltage and draws current from the transformer according to a load on the chair frame, wherein the electric motor provides the rotational power at a first rate according to the constant DC voltage.

* * * * *